US008309917B2

(12) United States Patent
Shiokawa et al.

(10) Patent No.: US 8,309,917 B2
(45) Date of Patent: Nov. 13, 2012

(54) MASS SPECTROMETRY AND MASS SPECTROMETER USED FOR THE SAME

(75) Inventors: Yoshiro Shiokawa, Hachioji (JP); Harumi Maruyama, Inagi (JP); Yasuyuki Taneda, Inagi (JP); Megumi Nakamura, Tama (JP)

(73) Assignee: Canon Anelva Corporation, Kawasaki-shi (JP)

( * ) Notice: Subject to any disclaimer, the term of this patent is extended or adjusted under 35 U.S.C. 154(b) by 274 days.

(21) Appl. No.: 12/632,464

(22) Filed: Dec. 7, 2009

(65) Prior Publication Data

US 2010/0163722 A1 Jul. 1, 2010

(30) Foreign Application Priority Data

Dec. 26, 2008 (JP) ..... 2008-335096
Nov. 5, 2009 (JP) ..... 2009-253865

(51) Int. Cl.
*H01J 49/00* (2006.01)

(52) U.S. Cl. ..... 250/288; 250/281; 250/282; 250/423 R; 250/424; 250/425

(58) Field of Classification Search ..... 250/281, 250/282, 288, 423 R, 424, 425
See application file for complete search history.

(56) References Cited

U.S. PATENT DOCUMENTS 7,202,474 B2 * 4/2007 Hirano et al. ..... 250/288
2009/0272894 A1 * 11/2009 Shiokawa et al. ..... 250/282

FOREIGN PATENT DOCUMENTS

JP 6-11485 A 1/1994
JP 2002-170518 A 6/2002

OTHER PUBLICATIONS

R. V. Hodges et al., "Application of Alkali Ions in Chemical Ionization Mass Spectrometry," Analytical Chemistry, vol. 48, No. 6, pp. 825-829 (May 1976).
Daniel Bombick et al., "Potassium Ion Chemical Ionization and Other Uses of an Alkali Thermionic Emitter in Mass Spectrometry," Analytical Chemistry, vol. 56, No. 3, pp. 396-402 (Mar. 1984).
Toshihiro Fujii et al., "Chemical Ionization Mass Spectrometry with Lithium Ion Attachment to the Molecule," Analytical Chemistry, vol. 61, No. 9, pp. 1026-1029 (May 1989).

* cited by examiner

*Primary Examiner* — Michael Maskell
*Assistant Examiner* — Hanway Chang
(74) *Attorney, Agent, or Firm* — Fitzpatrick, Cella, Harper & Scinto

(57) ABSTRACT

The present invention maintains a stable emission amount from an emitter. In an embodiment of the present invention, a solid sample or a liquid sample is heated to gasify an object to be measured contained in the solid sample or the liquid sample, thereby forming a neutral gaseous molecule, and a metal ion emitted from an emitter having an oxidized surface is attached to the neutral gaseous molecule to ionize the neutral gaseous molecule, which is subjected to mass spectrometry. The solid sample or the liquid sample is a sample that emits a reducing gas by heating. The heating for gasifying the object to be measured is performed at a temperature lower than the vaporization temperature of the solid sample or the liquid sample and not less than the vaporization temperature of the object to be measured, and an oxidizing gas is provided to the emitter.

10 Claims, 3 Drawing Sheets

MASS SPECTROMETRY AND MASS SPECTROMETER USED FOR THE SAME

BACKGROUND OF THE INVENTION

1. Field of the Invention

The present invention relates to ion attachment mass spectrometry and a mass spectrometer for measuring, in a fragment-free state, an object to be measured contained in a sample, and particularly to ion attachment mass spectrometry and a mass spectrometer for measuring, in a fragment-free state, an object to be measured contained in a sample that discharges a reducing gas or a sample that contains a reducing gas.

2. Description of the Related Art

In the mass spectrometry, the molecule of an object to be measured contained in a sample is ionized, and after that, ions are fractionated according to mass (mass number) by an electromagnetic technique to measure the intensity of each ion. The ionization part of the front half is called the ionization section (ionization apparatus), and the mass fractionation part of the latter half is called the mass spectrometry section (mass spectrometer). The mass spectrometry occupies a position of representative technique of instrumental analysis methods because of high sensitivity, accuracy thereof, or the like, and is utilized in such a wide range of fields as material development, product inspection, environmental research and bio study. In many of these, the spectrometer is used in a state connected to such a component separation device such as a gas chromatograph (GC), and there are such problems that the component separation requires the purification of a sample, and that such a long time as several ten minutes is necessary by the time the component separation is completed. In addition, there are such problems that an object to be measured contained in a sample may be changed in quality or lost in the component separation, deep knowledge and experience are necessary for the component separation, or the like.

Consequently, for the purpose of promptness, ease and high accuracy, a "direct measuring method," in which measurement is performed by a mass spectrometer alone without being connected to a component separation device, is also used.

There are some kinds of ionization apparatuses for use in the "direct measuring method", having a principle and structure significantly different from one another, and an ion attachment mass spectrometer has such advantage as capable of performing mass spectrometry of a gas to be detected without the generation of dissociation. Previously, Hodge (Analytical Chemistry vol. 48, No. 6, P825 (1976)), Bombick (Analytical Chemistry vol. 56, No. 3, P396 (1984), Fujii (Analytical Chemistry vol. 61, No. 9, P1026 (1989) and Japanese Patent Application Laid-Open No. 6-11485 reported on the ion attachment mass spectrometer.

FIG. 3 shows a conventional ion attachment mass spectrometer, which measures the mass number of an object to be measured contained in a sample by heating a solid sample or a liquid sample.

In FIG. 3, an emitter/ionization chamber 100 in which an emitter 107 is disposed and a sample vaporizing chamber 101 in which a sample 105 is disposed are arranged in a first chamber 130, and a mass spectrometer 160 is arranged in a second chamber 140. The pressure in the first and second chambers 130 and 140 is reduced by a vacuum pump 150. Accordingly, all of the emitter 107, emitter/ionization chamber 100, sample vaporizing chamber 101 and mass spectrometer 160 exist in an atmosphere of reduced pressure lower than atmospheric pressure (in vacuum).

The emitter 107 constituted of alumina silicate containing an oxide of an alkali metal such as lithium is heated to generate a metal ion 108 having a positive charge such as $Li^+$. That is, the emitter 107 is a sintered body in which an oxide, a carbonate or a salt of an alkali metal (such as Li) is incorporated into alumina silicate (a eutectic body of aluminum oxide and silicon oxide). When the emitter is heated to about 600° C. to 800° C. in an atmosphere of reduced pressure, it generates a positively charged alkali metal ion (the metal ion 108) such as $Li^+$ from the surface thereof.

The sample vaporizing chamber 101 is connected to the emitter/ionization chamber 100.

To the sample vaporizing chamber 101, a solid sample or a liquid sample (hereinafter, referred to as a solid/liquid sample) is inserted with a probe (not shown) from the outside, and a solid/liquid sample 105 disposed at the tip of the probe is heated with a heater (not shown). The solid/liquid sample 105 is vaporized (gasified), and, into the inside of the sample vaporizing chamber 101, a neutral gaseous molecule 106 of the solid/liquid sample 105 is discharged as a gas to be detected and introduced into the emitter/ionization chamber 100.

Consequently, neutral gaseous molecules 106 are ionized in the emitter/ionization chamber 100 to become ions.

Eventually, generated ions are given force from an electric field and are transmitted from the emitter/ionization chamber 100 to a mass spectrometer 160. Ions are fractionated depending on mass by the mass spectrometer 160 and detected.

Here, the metal ion 108 attaches to the neutral gaseous molecule 106 at a position where unevenness of charge exists, and a molecule to which the metal ion 108 is attached (an ion-attached molecule 109) becomes an ion having a positive charge as a whole. Since the attachment energy (energy for the attachment, which becomes an excess energy after the attachment) is very small, the neutral gaseous molecule 106 does not disintegrate and thus, the ion-attached molecule 109 becomes an ionized molecular ion while maintaining the original molecular shape.

However, after the attachment of the metal ion 108 to the neutral gaseous molecule 106, if the ion-attached molecule 109 is left as it is (kept in the state of holding the excess energy), the excess energy cuts the bond between the metal ion 108 and the neutral gaseous molecule 106. Then, the metal ion 108 is separated from the neutral gaseous molecule 106, which returns to the original neutral gaseous molecule 106. Therefore, such gas as $N_2$ (nitrogen) is introduced from a gas cylinder into the emitter/ionization chamber 100 up to a pressure of about 50 to 100 Pa to allow the gas molecule to collide frequently with the ion-attached molecule 109. As the result, the excess energy held by the ion-attached molecule 109 is transferred to the gas molecule to make the ion-attached molecule 109 stable.

The gas also has another function. That is, the gas is provided with such important function in the ion attachment process as decelerating the metal ion 108 emitted from the emitter 107 by the collision against itself to allow the easy attachment of the ion to the neutral gaseous molecule 106. The gas is referred to as the third body gas.

As a property necessary for the third body gas, there is such condition that the gas has to have a low attachment energy. If the third body gas has a great attachment energy and high sensitivity, the metal ion 108 that is limited in the generation amount attaches to the third body gas that exists in a large amount and is consumed, to thereby reduce the percentage of the attachment to the essential object to be measured (to lower the sensitivity). As shown in FIG. 3, the third body gas cylinder 170 is connected to the emitter/ionization chamber 100 via a laying pipe so that $N_2$ can be introduced into the emitter/ionization chamber 100 as the third body gas.

Incidentally, when an organic gas sample was used as the sample, a long measurement time occasionally led to the gradual decrease (on a week-by-week basis) in the generation amount (emission amount) of the metal ion from the emitter. Regarding the phenomenon that affects greatly the sensitivity and accuracy in the measurement, Japanese Patent Application Laid-Open No. 2002-170518 concludes that the decrease in the emission amount is caused by a gradual covering of the emitter surface with carbon or a high-molecular-weight organic compound. Under the recognition, Japanese Patent Application Laid-Open No. 2002-170518 discloses an invention in which the emission amount of the metal ion is secured by supplying an active gas for removing the organic compound on the emitter surface along with the third body gas to the ionization region, in a configuration using an organic gas sample.

On the other hand, there was a time when the emission amount from the emitter decreased even when the sample was a solid sample or a liquid sample (hereinafter, also referred to as a "solid/liquid sample"). For example, when the sample was resin (plastic), and when an object to be measured contained in the resin such as a "resin additive" added for improving various properties (such as flame resistance or flexibility) of the resin was intended to be measured, the emission amount of the metal ion from the emitter decreased during the measurement. However, in this case, such a phenomenon was found that the emission amount decreases during the heating of the sample, but that, after the completion of the heating, the emission amount gradually (on a second-by-second basis) increases and it largely returns to the initial emission amount in several ten minutes. The phenomenon can not be explained by the reason for the gas sample that it is caused by the emitter being covered with an organic compound, as described in the Japanese Patent Application Laid-Open No. 2002-170518.

The decrease in the emission amount causes the degradation of the detection lower limit, and particularly, the variation of the emission amount on a second-by-second basis is serious, which significantly degrades the quantitative accuracy to thereby halve the value as the mass spectrometer.

SUMMARY OF THE INVENTION

Objects of the present invention are to provide ion attachment mass spectrometry capable of maintaining a stable emission amount from an emitter even when performing ion attachment mass analysis using a solid sample or a liquid sample which emits a reducing gas by heating, and to provide an ion attachment mass spectrometer suitable for it.

The present inventor has intensively studied on the reason for the reduction in the emission amount to obtain the following knowledge.

As the measuring method of a "resin additive", generally the resin itself as a solid sample is not vaporized but is only softened, and only the highly-volatile "resin additive" contained as an additive is vaporized to be emitted. In order to measure a minute quantity of "resin additive", it is necessary to charge a large amount of a resin sample into a sample vaporizing chamber, and therefore, if even a large amount of resin is vaporized in the state, the contamination of an apparatus (particularly, the contamination of the emitter) progresses. As an example of specific measurement conditions, a sample is heated at about 300° C., that is, a temperature at which the "resin additive" is vaporized, but a temperature that is slightly lower than the vaporization (decomposition) temperature of the resin, and the temperature is held until the "resin additive" is vaporized and the emission thereof is completed.

There is a case where, by holding the resin at a temperature lower than the decomposition temperature (vaporization temperature) thereof, the covering of the emitter surface with organic carbons generated by the decomposition of the resin can be prevented or reduced, but gas contained in the resin or an unpolymerized component contained in the resin is emitted in a large amount. Most of the emitted gas is a reducing gas containing a H (hydrogen) atom.

In order to enable a neutral atom (an alkali metal atom) contained inside the emitter to be emitted from the surface as an ion (an alkali metal ion), an electron is required to be taken away from the atom at the surface, and it is considered that, for this, indispensably the surface is sufficiently oxidized (has an oxidized surface) so as to give a high work function.

The present inventor has presumed that the decrease in the emission amount from the emitter even when the sample was a solid/liquid sample was caused by the contact of a reducing gas emitted from a solid sample or a liquid sample such as resin to the emitter to weaken the oxidation degree of the emitter surface and to thereby decrease the emission amount, and has achieved the present invention.

The present invention is a method for mass spectrometry comprising heating a solid sample or a liquid sample to gasify an object to be measured contained in the solid sample or the liquid sample and to form a neutral gaseous molecule, and attaching a metal ion emitted from an emitter with an oxidized surface to the neutral gaseous molecule to ionize the neutral gaseous molecule, thereby performing mass analysis, wherein: the solid sample or the liquid sample is a sample that emits a reducing gas by heating, and the heating for gasifying the object to be measured is performed at a temperature which is lower than the vaporization temperature of the solid sample or the liquid sample and is not less than the vaporization temperature of the object to be measured, and an oxidizing gas is provided to the emitter.

In addition, the present invention is a mass spectrometer characterized by being provided with an emitter chamber having an emitter with an oxidized surface, and an oxidizing gas-introducing means for introducing an oxidizing gas; an ionizing chamber disposed adjacent to the emitter chamber and separated from the emitter chamber with a partition wall having an opening; and a sample vaporizing chamber for heating a solid sample or a liquid sample to gasify an object to be measured contained in the solid sample or the liquid sample to form a neutral gaseous molecule, the sample vaporizing chamber being constituted so as to introduce the neutral gaseous molecule into the ionizing chamber, wherein the neutral gaseous molecule is transported to the ionizing chamber, and a metal ion emitted from the emitter is attached to the neutral gaseous molecule in the ionizing chamber.

According to the present invention, it is possible to provide ion attachment mass spectrometry and an apparatus, capable of maintaining a stable emission amount even for a sample emitting a reducing gas or a sample containing a reducing gas, and excellent in quantitative accuracy along with various merits based on fragment-free.

DESCRIPTION OF THE EMBODIMENTS

Figure 1:
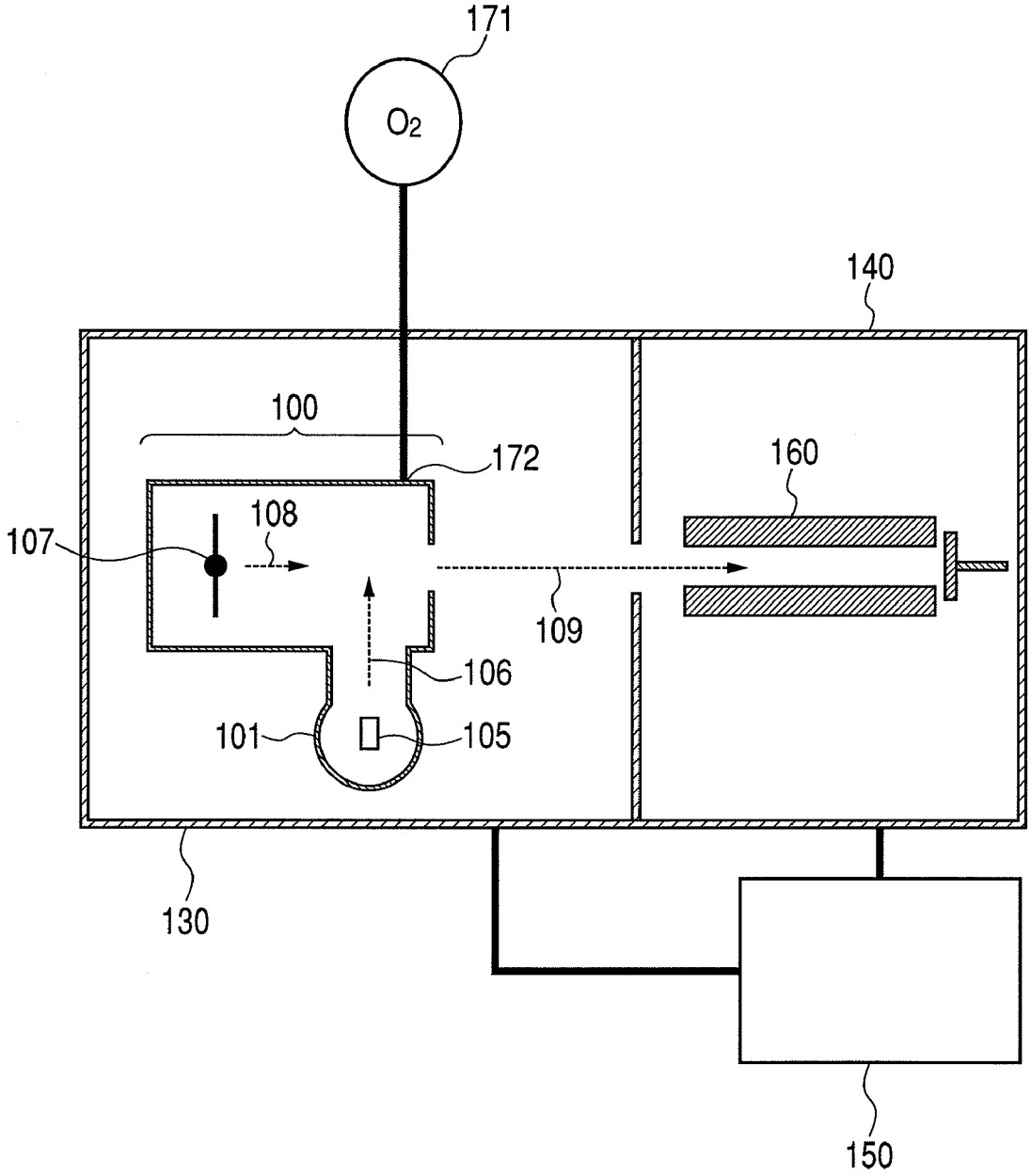
FIG. 1 is a schematic view of an example of a mass spectrometer used for mass spectrometry of the present invention.

Hereinafter, favorable embodiments of the present invention will be explained based on Examples using drawings. Meanwhile, in drawings explained below, members having the same function are denoted by the same reference numeral, and repeated explanation thereof is omitted.

First Example

FIG. 1 shows an example of an ion attachment mass spectrometer used for the ion attachment mass spectrometry of a first Example according to the present invention. The emitter/ionization chamber 100 in which the emitter 107 is located and the sample vaporizing chamber 101 in which the solid/liquid sample 105 is located are arranged in the first chamber 130. The mass spectrometer 160 is arranged in the second chamber 140. The pressure of the first and second chambers 130 and 140 is reduced by the vacuum pump 150. The emitter 107 is a sintered body formed by incorporating an oxide, carbonate or salt of an alkali metal into alumina silicate, and generates an alkali metal ion (the metal ion 108) from the surface thereof when being heated with an emitter-heating means (not shown) such as a heater to around 600° C. to 800° C. in an reduced-pressure atmosphere.

In the Example, the solid/liquid sample 105 contains a "resin additive," and a heater (not shown) being a sample-heating means is arranged in the sample vaporizing chamber 101, which heats the solid/liquid sample 105. By the control of a not shown control device, the heater heats the solid/liquid sample 105 at a temperature that is lower than the vaporization temperature of the solid/liquid sample 105 and is not less than the vaporization temperature of the "resin additive" contained in the solid/liquid sample 105. Then, the solid/liquid sample 105 itself that is heated by a heater being a heating means in the sample vaporizing chamber 101 is hardly vaporized, but the "resin additive" is vaporized, and the vaporized "resin additive" becomes the neutral gaseous molecule (gas) 106. At this time, since the solid/liquid sample 105 is heated at a temperature lower than the vaporization temperature of the solid/liquid sample 105, the vaporization of the solid/liquid sample 105 hardly occurs. But, in some cases, depending on the heating temperature, the solid/liquid sample 105 is also slightly vaporized. At this time, the neutral gaseous molecule 106 slightly includes the vaporized solid/liquid sample 105, but it can be said that the most of the neutral gaseous molecule 106 is occupied by the vaporized "resin additive".

The generated neutral gaseous molecule 106 moves in the direction of the emitter/ionization chamber and is introduced into the emitter/ionization chamber 100, and there, the molecule is attached to the metal ion 108 and ionized to thereby become a molecular ion. Eventually, the molecular ion is transported from the emitter/ionization chamber 100 to the mass spectrometer 160, and molecular ions are fractionated and measured for each mass by the mass spectrometer 160.

In the Example, the solid/liquid sample is a resin (plastic) sample, and the "resin additive" contained in the resin is measured. Specifically, in the Example, as the resin, acrylonitrile-butadiene-styrene (ABS) resin was used, and, as the "resin additive" being an object to be measured, a flame retardant such as polybromodiphenyl ether (PBDE) was analyzed.

In the Example, for the emitter/ionization chamber 100, an introducing port 172 for introducing gas is provided. To the emitter/ionization chamber 100, as the third body gas, $O_2$ (oxygen) being an oxidizing gas is introduced from an $O_2$ gas cylinder 171 connected to the introducing port 172 with an introducing pipe. That is, $O_2$ as the oxidizing gas, which is supplied from the $O_2$ gas cylinder 171, is provided to the emitter/ionization chamber 100 via the introducing port 172. The third body gas is preferably introduced so that the ion emitter chamber 100 has a pressure of 50 Pa to 100 Pa.

In the Example, as described above, the heating was performed so as to give a temperature not less than the vaporization temperature of the "resin additive" by a heater being the sample heating means. The heating temperature was not less than a temperature at which a reducing gas was emitted from the resin. The heating was performed up to a temperature slightly lower than the decomposition temperature (vaporization temperature) of the resin, at which the temperature was maintained constant. During the heating, the third body gas being the oxidizing gas was kept supplied.

As the result, even in the middle of heating the solid/liquid sample 105 in the sample vaporizing chamber 101, the decrease in the emission amount was generally solved to allow a constantly stable emission amount to be maintained. This is attributed to the recovery of the oxidation degree of the surface of the emitter 107, whose oxidation degree has been diminished by a reducing gas that generates from the resin being the solid/liquid sample 105 and contains a H (hydrogen) atom, by giving an oxidizing gas $O_2$ as the third body gas.

In the ionization method disclosed in Japanese Patent Application Laid-Open No. 2002-170518, a sample gas is supplied to the emitter/ionization chamber as a gas sample. At this time, when the gas sample is an organic gas sample, occasionally carbon or an organic compound of the gas sample attaches to the emitter surface to thereby lower the emission ability of the emitter. In Japanese Patent Application Laid-Open No. 2002-170518, in order to recover the emission ability, the inside of the emitter/ionization chamber is set to a temperature and pressure at which an active gas reacts with the attached carbon or an organic compound to remove the attached material, the active gas is introduced into the emitter/ionization chamber, and the emitter is heated. Consequently, the supplied active gas reacts with carbon or an organic compound attached and accumulated onto the emitter surface to remove the attached material.

In contrast, in the Example, as the sample, a solid or liquid sample (a solid/liquid sample) is used, and as the object to be measured, a "resin additive" contained in the solid/liquid sample is targeted. Accordingly, the sample that is a generation source of the neutral gaseous molecule and is arranged at the sample vaporizing chamber 101 is the solid/liquid sample 105 being a solid or liquid sample, and the solid/liquid sample 105 is heated so as to vaporize preferably only the "resin additive" contained in the solid/liquid sample 105 to generate the neutral gaseous molecule 106. That is, the solid/liquid sample 105 is heated at a temperature that is lower than the vaporization temperature of the solid/liquid sample 105 and is not less than the vaporization temperature of the "resin additive" contained in the sample.

Since the amount of the "resin additive" contained in the solid/liquid sample 105 is smaller than that of the solid/liquid sample 105, the amount of the vaporized "resin additive" contained in the neutral gaseous molecule 106 is also very small. Accordingly, even if the "resin additive" is an organic compound, and the neutral gaseous molecule 106 arrives at the surface of the emitter 107, since the amount of the "resin additive" having been vaporized is small, the amount of carbon or an organic compound, which is derived from the resin additive, attached to the surface of the emitter 107 is also very small. On the other hand, in the Example, the heating temperature is controlled so that the solid/liquid sample 105 occupying most percentage of the sample is not vaporized. Accordingly, even when an organic compound is used as the solid/liquid sample 105, it is possible to reduce the attachment and accumulation of the carbon or organic compound derived from the solid/liquid sample 105 to the surface of the emitter 107. Consequently, in the Example, the amount of the carbon or organic compound that attaches and accumulates on the surface of the emitter 107 can be reduced, and the emission ability of the emitter 107 can be maintained without using an active gas, differently from the invention disclosed in Japanese Patent Application Laid-Open No. 2002-170518.

As described above, the Example is based on the premise that a gas sample is not used differently from the invention disclosed in Japanese Patent Application Laid-Open No. 2002-170518 but a solid/liquid sample is used, and that further, a "resin additive" contained in the solid/liquid sample is measured. Therefore, the heating temperature of the solid/liquid sample being the generation source of the object to be measured (the resin additive) is set to a temperature that is not less than the vaporization temperature of the object to be measured and is lower than the vaporization temperature of the solid/liquid sample. This makes it possible to reduce the contamination of the emitter surface caused by carbon or an organic compound.

However, when the solid/liquid sample is used, there is a problem of the reducing gas, as described above. The problem of the reducing gas is a problem that is peculiar to a form in which the solid/liquid sample is used, and that does not exist in the case where a gas sample is used as the invention disclosed in Japanese Patent Application Laid-Open No. 2002-170518. That is, in the Example, when heating the solid/liquid sample 105, such a reducing gas as hydrogen is occasionally emitted from the resin being the solid/liquid sample 105, and the reducing gas occasionally lower the oxidation degree of the oxidized surface of the emitter 107 to thereby cause the lowering of the emission amount. Therefore, even if the attachment of the contaminant (carbon or an organic compound) to the surface of the emitter 107 can be reduced, the reduction of the oxidation degree of the surface of the emitter 107 leads to the lowering of the emission ability of the emitter 107.

In the Example, in order to suppress the lowering of the emission amount caused by the reducing gas, an oxidizing gas such as oxygen is provided to the emitter 107 as the third body gas. Since the provided oxidizing gas recovers the lowered oxidation degree of the surface of the emitter 107, it is possible to keep the oxidized surface of the emitter 107 in a good condition, and to suppress the lowering of the emission ability of the emitter 107.

As can be understood from above, in the Example, the heating temperature of the solid/liquid sample 105 is set so as to be lower than the vaporization temperature of the solid/liquid sample 105 and not less than the vaporization temperature of the "resin additive," and further, an oxidizing gas is used as the third body gas. Therefore, even if a reducing gas is generated, the oxidation degree of the oxidized surface of the emitter 107 can appropriately be maintained while reducing the contamination on the surface of the emitter 107 caused by the sample.

As described above, in the Example, while being based on the premise that the "resin additive" contained in the solid/liquid sample 105 being a sample is measured, the use of the solid/liquid sample 105 as a sample and the setting of the heating temperature of the solid/liquid sample 105 to a temperature lower than the vaporization temperature of the solid/liquid sample 105 and not less than the vaporization temperature of the "resin additive," and the use of an oxidizing gas as the third body gas are inseparably connected in order to obtain the special effect of the Example. That is, even when the attachment of a contaminant to the emitter surface may be reduced by setting the heating temperature of the solid/liquid sample used as a sample to a temperature lower than the vaporization temperature of the solid/liquid sample and not less than the vaporization temperature of the "resin additive," in the case where a reducing gas is emitted from the solid/liquid sample, the reducing gas reduces the oxidation degree of the emitter surface. However, by giving an oxidizing gas to the emitter as the third body gas, it is possible to recover the lowered oxidation degree and to suppress the lowering of the emission ability of the emitter.

Meanwhile, in the Example, the heating of the "resin additive" being the object to be measured is set so as to be not less than the emission temperature at which the reducing gas is emitted from the solid/liquid sample 105, but it may be lower than the emission temperature. In the Example, it is not important to cause a reducing gas to be emitted from the solid/liquid sample 105, but it is important to suppress the lowering of the ion emission ability of the emitter 107 even when the reducing gas is emitted from the solid/liquid sample 105. That is, in the Example, it is important, when using a liquid/solid sample that may emit a reducing gas depending on the situation, to recover the oxidation degree of the surface of the emitter 107, which has been lowered by the reducing gas, by giving an oxidizing gas to the emitter as the third body gas even when the reducing gas is emitted. Consequently, causing a reducing gas to be emitted from the solid/liquid sample 105 is not an indispensable condition.

As the third body gas, conventionally, inert nitrogen gas or argon gas was generally used, but, in the Example, oxygen being an oxidizing gas was used as the third body gas. The use of oxygen gas as the third body gas resulted in no problem in the analysis basically. This is attributed to the fact that the attachment energy of oxygen gas with the metal ion is 0.8 eV or less. That is, when the attachment energy is 0.8 eV or less, the metal ion 108 does not attach to the third body gas that exists in a large amount and is not consumed, and does not reduce the percentage of the attachment to the neutral gaseous molecule to be measured (lowering of sensitivity).

The oxidizing gas is a gas that accelerates the oxidation of a solid surface such as the emitter surface, including, for example, oxygen ($O_2$), ozone ($O_3$) and carbon dioxide ($CO_2$). As each of these has an attachment energy of 0.8 eV or less with the metal ion, it can be used preferably. The attachment energy is 0.8 eV for carbon dioxide, 0.7 eV for ozone and 0.5 eV for oxygen. But, as described later, one that has an attachment energy of greater than 0.8 eV can be used as the oxidizing gas by controlling the content.

The attachment energy mainly depends on the magnitude of the polarity of a neutral gaseous molecule, and the attachment energy value of each molecule is obtained from experiments or theories. The attachment energy value is derived from the temperature dependency of the attachment efficiency in the experiment, and from computer simulation based on the quantum theory in the calculation.

Meanwhile, regarding the use for a long period of time, depending on the material of a component, the component may be oxidized to cause the degradation. Therefore, regarding components which are contacted with the oxidizing gas and heated, the use of an oxidation-resistant material or the coating with an oxidation-resistant material as much as possible is preferable for the apparatus.

In the Example, a gas of 100% $O_2$ was used as the third body gas, but the change of the type of gas is also possible as follows.

As a first example, a gas of 100% dry air with a $H_2O$ content of 1% or less can be used. The dry air has such advantage that it can be generated from air with a simple machine without using a cylinder and is inexpensive even when the cylinder is used. The dry air has a low $O_2$ content ratio of 1/5, but, regarding the reduction of the emission amount, the same effect as that described above was obtained. But, as $H_2O$ has a considerably high attachment energy of 1.5 eV, the content must be set to 1% or less in order not to lower the sensitivity for the object to be measured in a sample.

As a second example, a gas of 100% $O_3$ (ozone), or a gas of 100% $CO_2$ (carbon dioxide) can be used. Each of these gases has an attachment energy of 0.8 eV or less and thus, does not lower the sensitivity for the object to be measured.

As a third example, other single component gasses of a 100% oxidizing gas having an attachment energy of 0.8 eV or less can be used.

As a fourth example, a mixed gas of at least two kinds selected from oxygen ($O_2$), ozone ($O_3$) and carbon dioxide ($CO_2$), and a mixed gas of at least one kind selected from oxygen ($O_2$), ozone ($O_3$) and carbon dioxide ($CO_2$) and another gas, the mixed gas having an attachment energy (an average value) of 0.8 eV, can be used.

Meanwhile, in the above Example, the measurement example of resin was used for the explanation, but as the sample, the present invention is effective for solid/liquid samples emitting a reducing gas that weakens the oxidation degree of the surface of the emitter 107 by heating, in addition to resin. Examples of solid/liquid samples emitting the reducing gas by heating include wood, cloth (natural or artificial), rubber (natural or artificial), building materials, oils, and the like. As a resin emitting the reducing gas by heating, in addition to ABS or PVC, polypropylene (PP), polystyrene (PS), polyethylene terephthalate (PET), low density polyethylene (LDPE), high density polyethylene (HDPE), polycarbonate, polyamide, polybutylene terephthalate, polyoxymethylene or modified polyphenylene ether may be used.

The reducing gas means a gas that accelerates the reduction, that is, reduces the oxidation degree of a solid surface such as the emitter surface, and contains a large amount of H in at least a molecule of the gas component.

Second Example

The present Example also uses a resin (plastic) sample as the solid/liquid sample, and aims at measuring the "resin additive" contained in the resin. The sample was a solid sample easily oxidized as compared with that in the first Example.

Specifically, as the resin, polyvinyl chloride (PVC) resin was used, and as the "resin additive," a plasticizer such as phthalic ester was analyzed.

Figure 2:
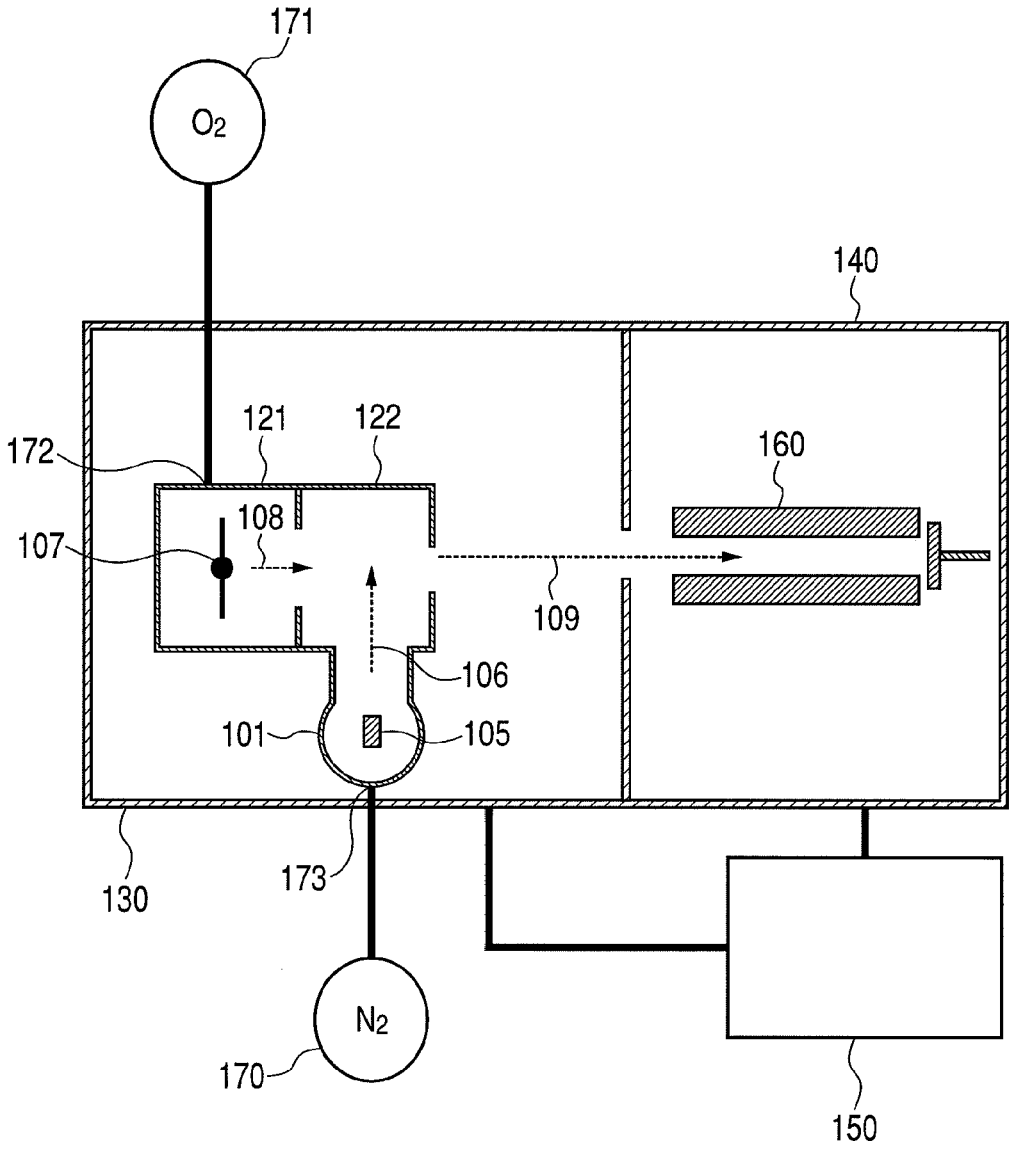
FIG. 2 is a schematic view of another example of a mass spectrometer used for mass spectrometry of the invention.
Figure 3:
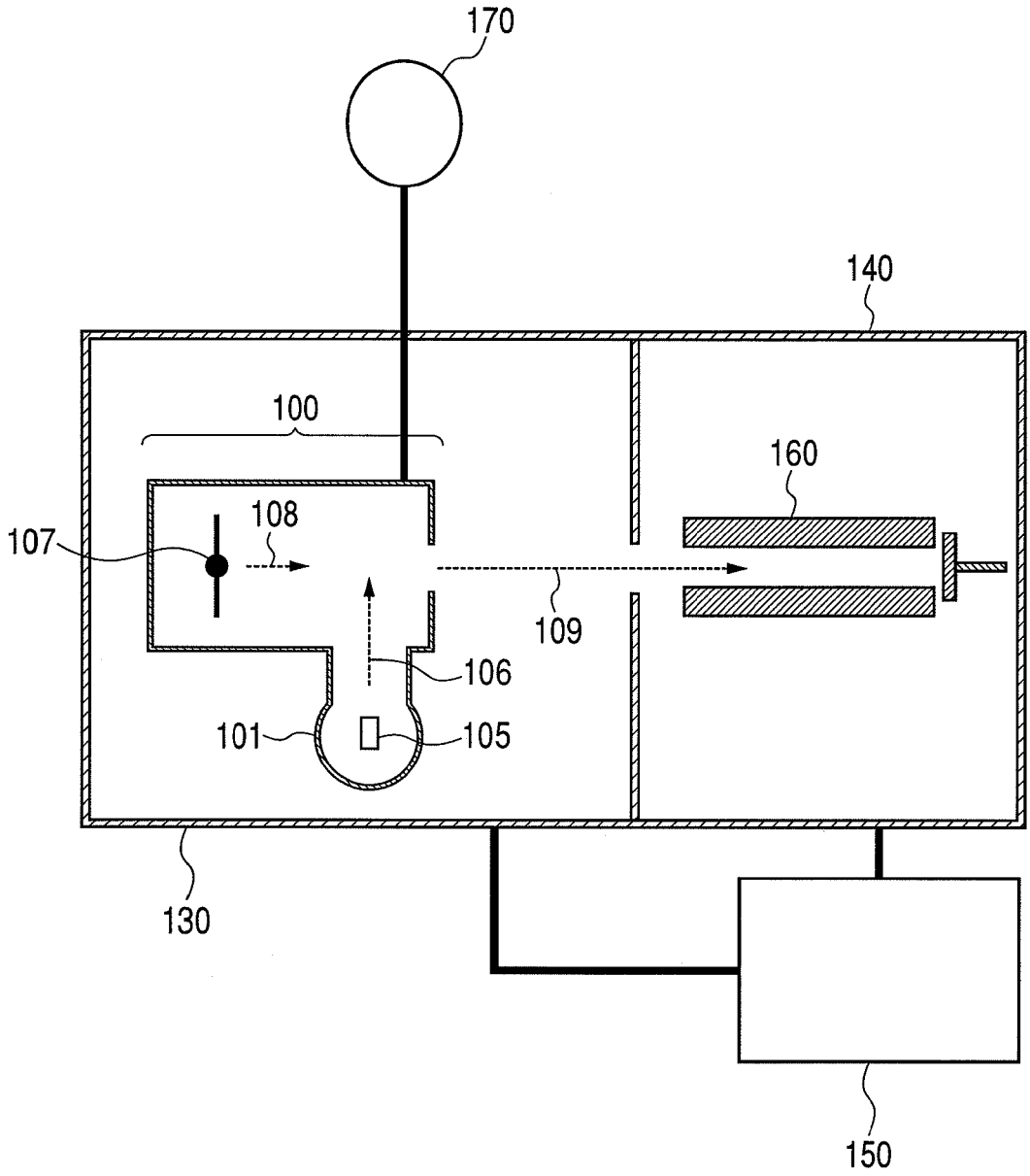
FIG. 3 is a schematic view showing the constitution of a conventional mass spectrometer.

FIG. 2 shows an outline view of an ion attachment mass spectrometer used in the Example. In FIG. 2, the same constitutional member as that in FIG. 1 is denoted by the same reference numeral.

In the ion attachment mass spectrometer in FIG. 2, an ionizing chamber 122 for causing the metal ion introduced from the emitter chamber 121 to attach to a neutral gaseous molecule to thereby ionize the neutral gaseous molecule is separated from the emitter chamber 121 by a partition wall 120 having an opening portion. In the emitter chamber 121, the emitter 107 is arranged, and the ionizing chamber 122 is constituted so that the neutral gaseous molecule 106 generated in the sample vaporizing chamber 101 is introduced into the ionizing chamber 122, and is connected to the sample vaporizing chamber 101. In the sample vaporizing chamber 101, the solid/liquid sample 105 is heated at a temperature lower than the vaporization temperature of the solid/liquid sample 105 and not less than the vaporization temperature of the "resin additive" contained in the solid/liquid sample 105, by a heater as a sample heating means. In the solid/liquid sample 105 thus heated, the "resin additive" is vaporized to thereby become the neutral gaseous molecule (gas) 106. The emitter chamber 121 is provided with a introducing port 172 for introducing the oxidizing gas, through which $O_2$ (oxygen) from an $O_2$ gas cylinder 171 is introduced into the emitter chamber 121 as a part of the third body gas.

To the sample vaporizing chamber 101, an $N_2$ gas cylinder 170, which works as a gas-introducing means for positively transporting the neutral gaseous molecule (gas) obtained by vaporizing the "resin additive" to the ionizing chamber 122, is connected. In the Example, in the sample vaporizing chamber 101, an introducing port 173 for introducing the gas is provided, and the $N_2$ gas cylinder 170 and the introducing port 173 are connected with an introduction pipe. In the constitution, the ion attachment mass spectrometer according to the Example introduces $N_2$ as a transport gas supplied from the $N_2$ gas cylinder 170 into the sample vaporizing chamber 101 via the introducing port 173.

That is, the flow of the transport gas from the sample vaporizing chamber 101 to the ionizing chamber 122 is actualized, and as the transport gas, nitrogen ($N_2$) gas being an inert gas is used. As the result, $O_2$ (oxygen) flowing from the emitter chamber 121 into the ionizing chamber 122 is blocked by the transport gas and hardly enters the sample vaporizing chamber 101. Accordingly, even when a sample that is easily influenced by oxygen gas being the oxidizing gas at heating is used as the solid/liquid sample 105, by the use of the apparatus of the Example, the solid/liquid sample 105 is hardly influenced by the oxidizing gas. The nitrogen gas being an inert gas that is introduced from the $N_2$ gas cylinder 170 also functions as the third body gas.

Meanwhile, in the Example, the case where the inert gas as the transport gas is nitrogen gas is explained, but as the inert gas, such noble gas as argon or helium can also be used. In the Example, it is preferable that the solid/liquid sample 105 or neutral gaseous molecule 106 arranged in the sample vaporizing chamber 101 does not react with the transport gas, as much as possible. Accordingly, the inert gas is preferable as the transport gas that helps the transport of the neutral gaseous molecule 106, because it is chemically stable, and hardly reacts with the solid/liquid sample. Further, without being limited to the inert gas, the use of a gas that hardly reacts with the solid/liquid sample 105 to be arranged as the transport gas is also preferable.

As described above, in the Example, the emitter chamber 121 and the ionizing chamber 122 are provided adjacently, and the emitter chamber 121 and the ionizing chamber 122 are separated with the partition wall 120 having an opening portion, and the introducing port 172 connected to the $O_2$ gas cylinder 171 is provided for the emitter chamber 121. Accordingly, the supply of $O_2$ as the oxidizing gas, which has been supplied to the emitter chamber 121 via the introducing port 172, to the ionizing chamber 122 side is suppressed by the presence of the partition wall 120, and $O_2$ can be efficiently provided to the emitter 170 for which the supply of the oxidizing gas is intended.

As described above, the partition wall 120 is provided for the purpose of suppressing the introduction of the oxidizing gas into the ionizing chamber 122, but the metal ion 108 generated from the emitter 107 has to be introduced into the ionizing chamber 122. Accordingly, the partition wall 120 is provided with the opening portion. The metal ion 108 is introduced from the emitter chamber 121 into the ionizing chamber 122 via the opening portion, and the introduction of the oxidizing gas from the emitter chamber 121 into the ionizing chamber 122 is suppressed by the partition wall 120.

Now, since the opening portion is provided for the partition wall 120, there exists the oxidizing gas that is going to be introduced into the ionizing chamber 122. Therefore, in the Example, the $N_2$ gas cylinder 170 is connected to the sample vaporizing chamber 101 connected to the ionizing chamber 122 via the introducing port 173, and $N_2$ gas as the transport gas is introduced into the sample vaporizing chamber 101, to thereby form a flow of the transport gas going from the sample vaporizing chamber 101 to the ionizing chamber 122. Accordingly, even when the oxidizing gas is introduced into the ionizing chamber 122, since the transport gas flows from the sample vaporizing chamber 101 into the ionizing chamber 122, no or only a little oxidizing gas is introduced into the sample vaporizing chamber 101. And, by introducing the transport gas, it is possible to efficiently introduce the neutral gaseous molecule 106 generated in the sample vaporizing chamber 101 into the ionizing chamber 122 along the flow of the transport gas.

As described above, in the Example, since $N_2$ as the transport gas is introduced into the sample vaporizing chamber 101, it is possible to cause the gas to be flown out of the sample vaporizing chamber 101 to flow out efficiently, and to block a gas that is not to be flown into the sample vaporizing chamber 101.

By using the ion mass spectrometer of the Example, since the oxidation of the emitter can be recovered by supplying $O_2$ being the oxidizing gas to the emitter chamber, and the incursion of a sample gas vaporized from a solid sample into the emitter chamber can be reduced, the effect on the emission amount becomes larger by a synergistic effect.

In the Examples, the kind of ion is not specified as the metal ion 108. Specifically, an alkali metal ion such as $Li^+$, $Na^+$, $K^+$, $Rb^+$ or $Cs^+$, and in addition, $Al^+$, $Ga^+$, $In^+$ or the like can be used. As the mass spectrometer, any kind of mass spectrometer may be used, including a Q pole type mass spectrometer (QMS), an ion trap type mass spectrometer (IT), a magnetic field sector type mass spectrometer (MS), a time-of-flight type mass spectrometer (TOF), an ion cyclotron resonance type mass spectrometer (ICR) and the like.

Further, as the whole structure, a two-room structure constituted of the first chamber provided with the ionizing chamber and the second chamber provided with the mass spectrometer is shown, but the structure is not limited to this. The pressure of the space outside the ionizing chamber is 0.01 to 0.1 Pa, and, in a mass spectrometer capable of operating under the pressure, a one-room structure is possible. On the other hand, mass spectrometers that require an incomparably low pressure have a three-room or four-room structure. Generally, it is considered to be suitable that subminiature QMS and IT have a one-room structure, ordinary QMS and MS have a two-room structure, TOF has a three-room structure, and ICR has a four-room structure.

The present invention can adapt to the ion attachment mass spectrometry and mass spectrometer that measure, in a fragment-free state, an object to be measured contained in a sample that emits a reducing gas, or a sample that contains a reducing gas.

What is claimed is:

1. A method for mass spectrometry comprising heating a solid sample or a liquid sample to gasify an object to be measured contained in the solid sample or the liquid sample and to form a neutral gaseous molecule, and attaching a metal ion emitted from an emitter with an oxidized surface to the neutral gaseous molecule to ionize the neutral gaseous molecule, thereby performing mass analysis, wherein:

the solid sample or the liquid sample is a sample that emits a reducing gas by heating, the heating for gasifying the object to be measured is performed at a temperature which is lower than the vaporization temperature of the solid sample or the liquid sample and is not less than the vaporization temperature of the object to be measured, and an oxidizing gas is supplied to the emitter by introducing the oxidizing gas into a chamber in which the emitter is located to suppress lowering of an emission ability of the emitter caused by the reducing gas emitted from the solid sample or the liquid sample.

2. A method for mass spectrometry according to claim 1, wherein the oxidizing gas is at least one kind selected from oxygen, ozone and carbon dioxide.

3. A method for mass spectrometry according to claim 1, wherein the reducing gas contains H (hydrogen).

4. A method for mass spectrometry according to claim 1, wherein the solid sample is a resin.

5. A method for mass spectrometry according to claim 4, wherein the object to be measured is a resin additive contained in the resin.

6. A method for mass spectrometry according to claim 1, wherein a transport gas is supplied to a sample vaporizing chamber for which the solid sample or the liquid sample is arranged to thereby form the flow of the transport gas from the sample vaporizing chamber to a region where the ionization of the neutral gaseous molecule is performed.

7. A mass spectrometer comprising:

an emitter chamber having an emitter with an oxidized surface, the emitter being located in the emitter chamber, and an oxidizing gas-introducing means for supplying an oxidizing gas to the emitter;

a sample vaporizing chamber adapted to gasify an object to be measured contained in a solid sample or a liquid sample to thereby be a neutral gaseous molecule; and an ionizing chamber adapted to attach a metal ion emitted from the emitter, to the neutral gaseous molecule introduced from the sample vaporizing chamber, wherein the oxidizing gas-introducing means supplies the oxidizing gas by introducing the oxidizing gas into the emitter chamber to suppress the lowering of an emission ability of the emitter, when the object to be measured is gasified.

8. A mass spectrometer according to claim 7, wherein the sample vaporizing chamber is further provided with a transport gas-introducing means for introducing a transport gas to with the neutral gaseous molecule to the ionizing chamber.

9. A mass spectrometer according to claim 8, wherein the transport gas is a gas that hardly reacts with a solid sample or a liquid sample disposed in the sample vaporizing chamber.

10. A mass spectrometer according to claim 8, wherein the transport gas is an inert gas.

* * * * *